US007419368B2

(12) United States Patent
Milks

(10) Patent No.: US 7,419,368 B2
(45) Date of Patent: Sep. 2, 2008

(54) AIR CIRCULATION DEVICE

(75) Inventor: Stephen A. Milks, Lapeer, MI (US)

(73) Assignee: Fan-Tastic Vent Corporation, Imlay City, MI (US)

( * ) Notice: Subject to any disclaimer, the term of this patent is extended or adjusted under 35 U.S.C. 154(b) by 160 days.

(21) Appl. No.: 10/038,062

(22) Filed: Jan. 4, 2002

(65) Prior Publication Data

US 2003/0129071 A1 Jul. 10, 2003

(51) Int. Cl.
*F04B 17/03* (2006.01)
*H02K 21/26* (2006.01)

(52) U.S. Cl. ..... 417/423.7; 417/423.14; 310/154.32

(58) Field of Classification Search ..... 417/423.1, 417/423.7, 423.14, 352, 360; D23/381, 382, D23/301, 302; 310/83, 154, 154.05, 154.06, 310/154.32, 68, 156.32
See application file for complete search history.

(56) References Cited

U.S. PATENT DOCUMENTS

D180,783 S * 8/1957 Helms et al. ..... D23/381
3,030,145 A * 4/1962 Kottemann ..... 297/180.11
3,144,574 A * 8/1964 Henry-Baudot ..... 310/268
3,280,353 A * 10/1966 Haydon et al. ..... 310/154.05
3,348,086 A * 10/1967 Monma ..... 310/268
3,566,165 A * 2/1971 Lohr ..... 310/67 R
3,733,150 A * 5/1973 Porter et al. ..... 417/424.1
3,860,404 A * 1/1975 Jochimski ..... 96/147
3,879,623 A * 4/1975 Miyake ..... 310/83
3,890,963 A * 6/1975 Patterson ..... 607/60
4,141,320 A * 2/1979 Hatfield ..... 119/319
4,291,455 A * 9/1981 Schnyder ..... 29/596
4,303,844 A * 12/1981 Suzuki ..... 310/154.05
4,633,769 A * 1/1987 Milks ..... 454/117
4,684,839 A * 8/1987 Fujisaki et al. ..... 310/154.05
4,900,957 A * 2/1990 Barker et al. ..... 310/62
5,095,612 A * 3/1992 McAvena ..... 29/596

(Continued)

OTHER PUBLICATIONS

"Fan-Tastic Vent" print-out of website, www.fantasticvent.com.*

(Continued)

*Primary Examiner*—Charles G Freay
(74) *Attorney, Agent, or Firm*—Harness, Dickey & Pierce, P.L.C.

(57) ABSTRACT

The present invention is directed towards an air circulation device. The air circulation device is capable of producing and directing an air current to a desired location. The air current is used to circulate stagnant air which, in turn, provides a cooling effect. Advantageously, the device is electrically powered by 12-volt direct current (DC) but is capable of producing an air current of a magnitude similar to or greater than that produced by air circulation devices which are powered by 120-volt alternating current (AC). Further, the device contains at least one retractable elongated support which allows the device to stand upright on a flat surface when the support is in an extended position. When the device is not in use, the support may be retracted so as to be protected from being damaged during transport. Still further, the device is manufactured of a polymeric material and the motor and bearings of the device are sealed. As a result, the device may be easily and safely cleaned using a liquid solution applied by a high pressure device such as a hose.

11 Claims, 3 Drawing Sheets

U.S. PATENT DOCUMENTS 5,099,181 A * 3/1992 Canon ..... 318/254
5,109,171 A * 4/1992 Schmider ..... 310/51
5,110,263 A * 5/1992 Chiu ..... 416/244 R
5,148,895 A * 9/1992 Kakizaki ..... 188/282.2
5,232,090 A * 8/1993 Raab et al. ..... 206/320
5,270,596 A * 12/1993 Shibuya et al. ..... 310/40 MM
5,660,367 A * 8/1997 Rush ..... 248/674
5,725,356 A * 3/1998 Carter ..... 416/240
5,839,205 A * 11/1998 Hung ..... 417/423.5
5,929,544 A * 7/1999 Maekawa et al. ..... 310/88
6,168,517 B1 * 1/2001 Cook ..... 454/269
6,309,192 B1 * 10/2001 Litvin ..... 417/423.14
6,440,190 B1 * 8/2002 Goyetche ..... 55/473

OTHER PUBLICATIONS

"Fan-Tastic Vent Model 4000R brochure", www.fantasticvent.com, Nov. 1, 2001.*
12V WindMachine provided by Jade Mountain found at http://www.jademountain.com/heatcool//sindmaker.html., Jun. 2000.
12-V Fans provided by Chagnon's Outdoor World found at http://www.outdoor-catalog.com/power/air_fans.htm., Sep. 2001.
12-Volt Brushless Fan provided by Kollmann Marine, Inc. found at http://www.kollmann-marine.com/fans.html. Sep. 2001.
Oscillating 12 Volt Mini-Fan provided by Solar Generators found at http://www.solargenerators.com/fans.htm. Sep. 2001.
Ultra-Thin Line 12-Volt Electric Fans provided Fluidyne Racing Products found at http://fluidyne.com/fans.html. Sep. 2001.

* cited by examiner

AIR CIRCULATION DEVICE

BACKGROUND OF THE INVENTION

1. Field of the Invention

The present invention generally relates to air circulation devices. More particularly, the present invention relates to a water-resistant, 12-volt direct current, self-supporting, box fan.

2. Background of the Invention

Air circulation devices are commonly used to produce and direct air current to a desired location. The air current can be used to circulate stagnant air and produce a cooling effect. Common air circulation devices consist of rotating fans with angled fins such that rotation of the fins pulls air from behind the device and propels air through the device, to produce an air current. Accordingly, a person situated in front of the device is subject to a constant flow of cool, circulating air. Exposure to such an air current results in the person being more comfortable when atmospheric conditions become undesirably warm.

Air circulation devices such as that described above, are often manufactured to be easily transported devices operated by a 12-volt direct current (DC) power source, such as that supplied by a motor vehicle cigarette lighter outlet or a watercraft power outlet. Such air circulation devices are also often manufactured to include a support mechanism so as to allow the air circulation device to independently stand upon or be suspended from a surface with varying features. However, such air circulation devices traditionally have a small fin diameter, are of a small overall size, contain support mechanisms which extend beyond the boundaries of the device, are made of materials which are not water resistant, and contain exposed motor components and bearings. Consequently, such air circulation devices are only able to produce an air current of minor strength when compared to an air current produced by a device powered by a standard household electrical outlet which produces 120-volts of alternating current (AC). Additionally, because the support mechanisms extend beyond the boundaries of the device, they are subject to being easily damaged during the jostling that such a device is subject to during transport as well as during normal everyday use. Further, because the current devices are not water resistant, are subject to corrosion, and have exposed motor components and bearings, the devices are vulnerable to being damaged as a result of contact with water, a cleaning solution, or other liquids applied by either high pressure spraying or simple hand application using a towel or rag.

While many air circulation devices exist and have proven to be commercially acceptable for their intended applications, they are all subject to improvement. In this regard, it is desirable to develop a 12-volt DC air circulation device which has a large fin diameter, the fins being rotated at such a speed so as to produce and direct an air current with a magnitude similar to or greater than that produced by 120-volt AC powered air circulation devices. In addition, it is desirable to produce an air circulation device with a support stand having extended and retracted positions. In the extended position the support stand extends beyond the device to provide upright support for the device. In the retracted position the support stand does not extend beyond the device and thus the support is shielded from being damaged during transport or when subject to normal everyday jostling. Still further, it is desirable to produce an air circulation device generally made of a non-corrosive, water resistant polymeric material. The device further having a liquid impermeable, rigid motor casing which is able to protect the motor from being damaged by external forces or liquids, such as rain water or water used to clean the device applied by a high pressure hose.

SUMMARY OF THE INVENTION

The above and other objects of the present invention are provided by an air circulation device capable of directing an air current to a desired location. The air current is used to circulate stagnant air so as to provide a cooling effect. More particularly, the air circulation device includes a box frame containing a rotating fan comprised of numerous angled fins which are rotated by a motor. The motor is powered by 12-volt direct current. The rotating fins are capable of drawing air from behind the box frame and propelling the air through the box frame. The rotating fins are of a sufficient magnitude and are rotated at such a speed that the air current produced is equal to or greater than that produced by air circulation devices which are powered by 120-volt alternating current (AC).

The box frame is supported upon a flat surface by one or more elongated support members which are secured to a bottom face of the air circulation device and extend beyond the bottom face of the device. The support members may be rotated between extended or contracted positions. In the extended position, the support members are capable of supporting the air circulation device in an upright position. In the contracted position, the support members do not protrude from under the air circulation device and thus are protected from being damaged by the normal jostling that such a device is subject to during stationary use or during transport. The components of the air circulation device are made of a polymeric material and the motor bearings are sealed in a rigid, preferably metal, casing. Consequently, the device may be exposed to a liquid solution without the device being corroded or damaged in any manner. The circulation device is resistant to liquids applied not only by hand using a towel for example, but also to liquids applied at high pressure by a device such as a hose.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

The following description of the preferred embodiments is merely exemplary in nature and is in no way intended to limit the invention, its application, or uses.

Figure 1:
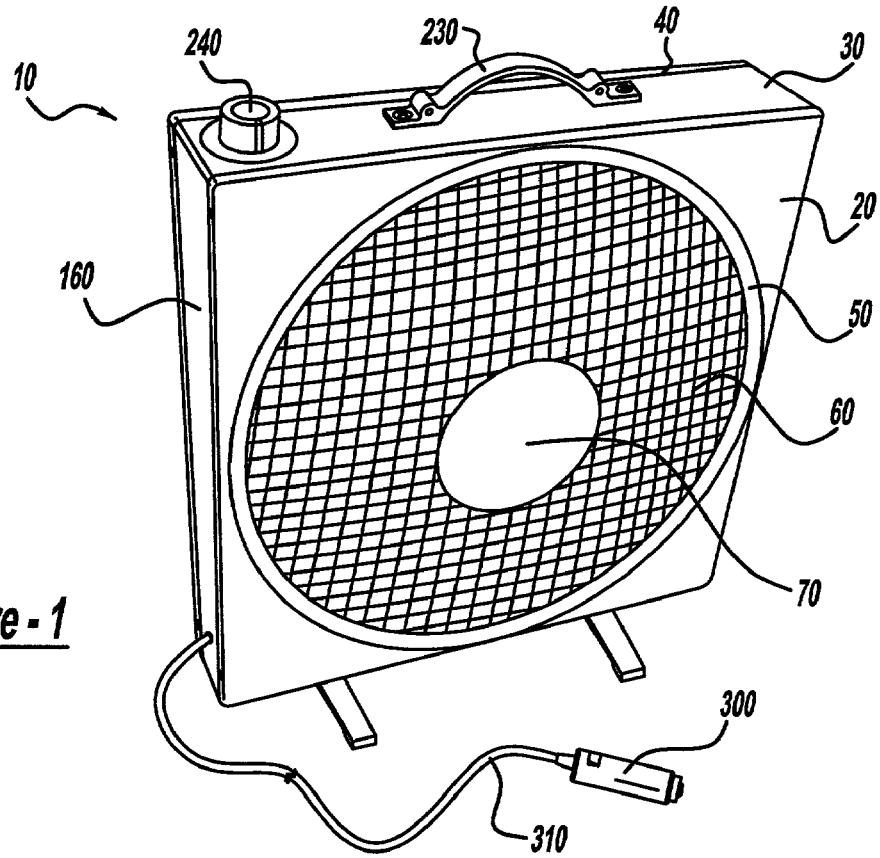
FIG. 1 is a schematic illustration of a front face of an air circulation device.

FIG. 1 illustrates an air circulation device 10 made of a polymeric material. The device 10 contains a front face 20, a main base 30 and a rear face 40. The front face 20 and rear face 40 each contain a large circular opening 50 through which air passes into and out of the air circulation device 10. The circular opening 50 is covered with a lattice structure so that the large opening 50 is divided into a plurality of smaller openings 60. The smaller openings 60 are of a size sufficient to enable air to pass through the openings 60 while preventing the passage of other materials which are of a size greater than the openings 60. A solid cover region 70 is at the center of each circular opening 50. The solid cover region 70 covers a rigid motor casing 80, the casing being secured to the main base 30 by a suitable fastening device. Additionally, the front face 20 and rear face 40 contain a peripheral flange 90. The flange 90 contains a plurality of holes 100 which are aligned with a plurality of holes 110 of a flange 120 of main base 30. The front face 20 and rear face 40 are both secured and sealed to the main base 30 through the use of fastening devices, preferably in the form of screws 130. The screws 130 are inserted through the holes 100 of the front face 20 or rear face 40 so as to engage holes 110 present in the flange 120 of the main base 30.

To further secure the front face 20 and the rear face 40 to the main base 30, the front face 20 and the rear face 40 may optionally be provided with at least one tab 140. The tabs 140 are preferably located between the flange 90 and large opening 50 at approximately the mid-point of the peripheral flanges 90 of either the front face 20 or rear face 40. The tabs 140 are preferably made of a polymeric material and are fused with the main base 30 at a mid-point along the interior of flange 120. Thus, the front face 20 and rear face 40 may be secured to the main base 30 not only by screws 130 but also by tabs 140.

The main base 30 is comprised of a top face 150, a bottom face 160, and two side faces 170, each of which contain flange 120. The interior of the main base 30 includes a periphery casing 180 with a large circular channel 190. A plurality of supports 200 are disposed within the circular channel 190. The plurality of supports 200 support a motor mount 210. The sealed motor casing 80 is secured to the motor mount 210 through the use of a plurality of fasteners, the fasteners preferably in the form of screws 220. The top face 150 includes a handle 230 and a control knob 240 (both to be further described below). The bottom face 160 includes at least one elongated support portion 250 (to be further described below).

Protruding from the motor casing 80 is an axle 255 driven by the motor within casing 80. The axle 255 is fastened to a fan blade 260 by a suitable fastening means at center fastening point 270. Center fastening point 270 contains a receptor 280 to receive and seal the axle 255 to the fan blade 260 using a suitable fastening device. Rotation of axle 255 results in rotation of fan blade 260. The fan blade 260 contains a plurality of angled fins 290 and is approximately twelve inches in diameter. When the fan blade 260 is rotated, the angled fins 290 cause air to be pulled into the device through the rear face 40 and propelled through the device and out front face 20. The air current produced by the rotating angled fins 290 results in an air current exhausted from the front face which provides a cooling effect.

The flat motor within motor casing 80 is powered by a 12-volt DC electric current. The motor is sealed within the casing 80, the casing 80 being made of a rigid material, preferably metal. Consequently, the casing 80 protects the motor from being damaged by the everyday external forces and pressures which such a device is subject to. The casing 80 is also sealed such that it is impermeable to water or other liquids so as to protect the motor from being damaged by liquids such as cleaning solutions. Further, because the casing 80 is both rigid and impermeable to water, the casing 80 protects the motor from liquids applied not only by hand but also from those applied by high pressure spraying. Thus, the motor, and the rest of the fan, may be easily and safely cleaned using a liquid solution applied not only using a towel or rag but also by a high pressure hose.

The motor is powered by 12-volt DC current which may be supplied by an electrical outlet of a motor vehicle or watercraft or from a DC battery. Thus, the air circulation device 10 includes a connection device 300 so as to cooperate with a 12-volt DC power supply or a power supply socket (not shown). The connection device 300 may be of any suitable device capable of conducting 12-volt DC power from a power source. The connection device 300 is connected to the flat motor within casing 80 by way of a conducting cord 310 which extends from the motor through the main base 30 to the connection device 300.

The operation of the motor is controlled by a control device in the form of control knob 240 located on top face 150. The control knob 240 has at least two positions, on and off. In addition to the on and off positions, the control knob 240 may have a plurality of other positions representing the different speeds of a variable speed motor. The user is also able to control the magnitude of the air current produced, by being able to control the speed of the motor and thus the speed of angled fins 290.

The handle 230 secured to top face 150 may be used to easily transport the air circulation device 10. The handle 230 is comprised of two base portions 320 connected by an arched portion 330. Each of the base portions 320 contain a receptacle 340 which is capable of receiving a fastening device which is preferably in the form of a screw 350. The screw 350 is inserted through the receptacle 340 of the base portion 320 to engage a receptacle 360 in the main base 30. In this manner, the screw 350 securely fastens base portion 320 to top face 150. The handle 230 also has a receptacle 370 located between the base portion 320 and the arched portion 330. Receptacle 370 is horizontal to the top face 150 and may be engaged by any suitable horizontally extending mounting device so as to suspend the device 10 from such a horizontally extending mounting device.

The elongated support portion 250 is secured to the exterior of bottom face 160. The support portion 250 enables the device 10 to stand on a flat surface in an upright position. The support portion 250 is comprised of a base member 380 which terminates in two surface contact portions 390. The underside of the surface contact portions 390 are preferably fitted with a material, such as rubber, which is capable of creating friction between the surface contact portions 390 and the surface which device 10 is placed upon. At the center of the base member 380 is a raised mid-portion 400. The raised portion 400 contains a fastening device receptor 410 and a knob 420.

Figure 5:
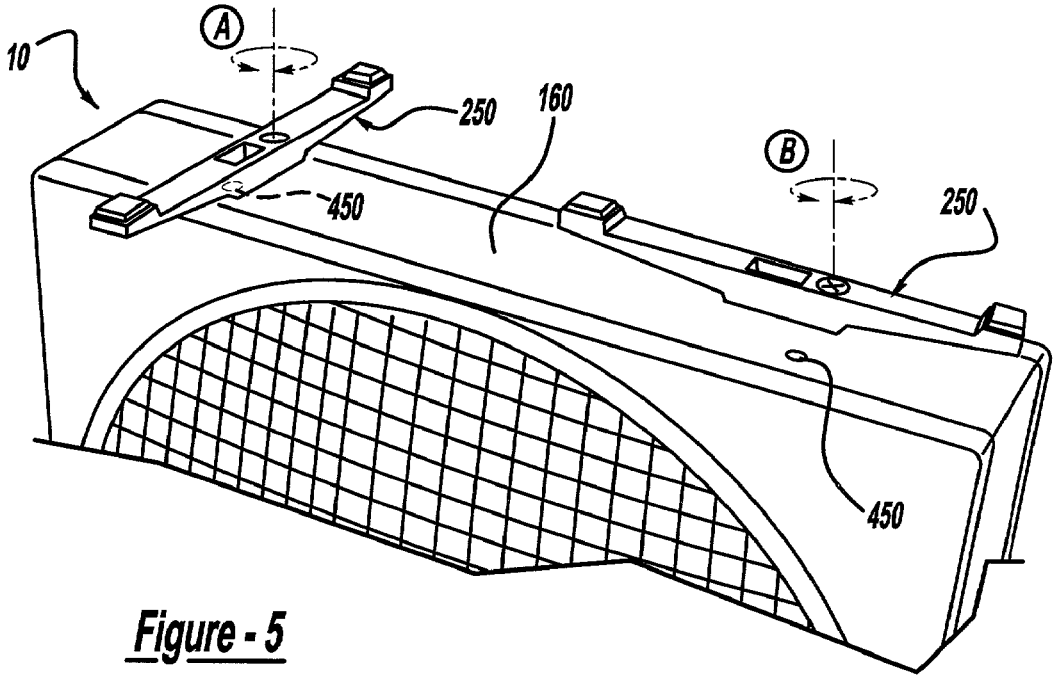
FIG. 5 is a schematic illustration of the extended and retracted positions of the elongated support members of the main base.
Figure 2:
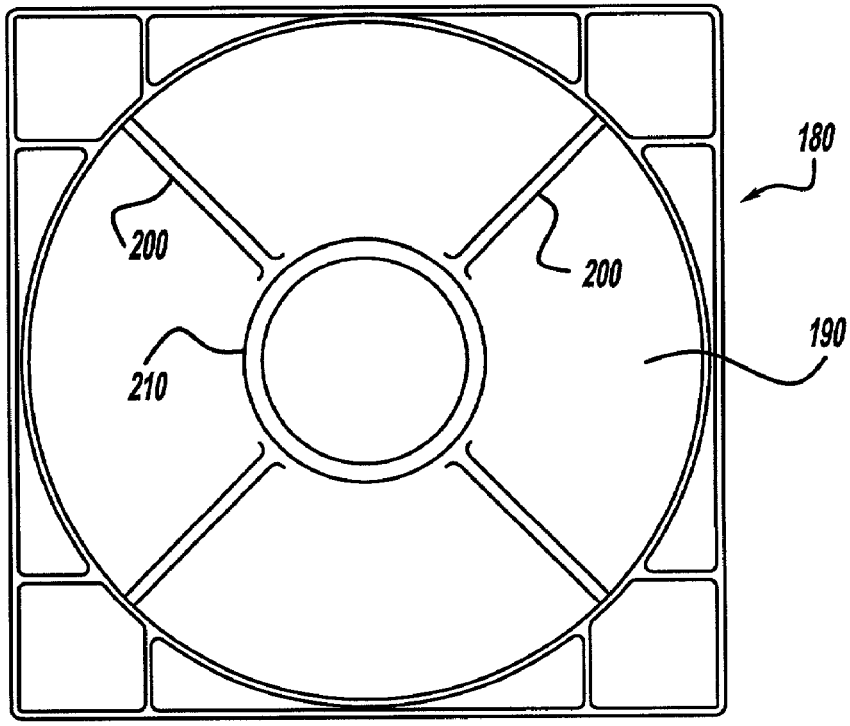
FIG. 2 is a schematic illustration of a main base of an air circulation device.
Figure 4:
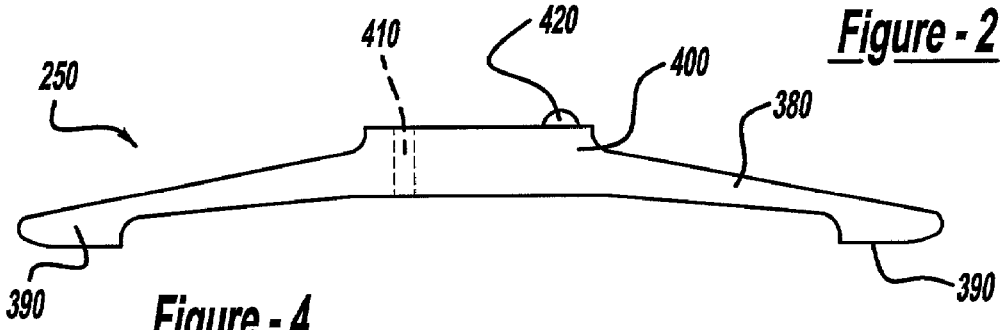
FIG. 4 is an enlarged illustration of elongated support members which are fastened to a bottom face of the main base.
Figure 6:
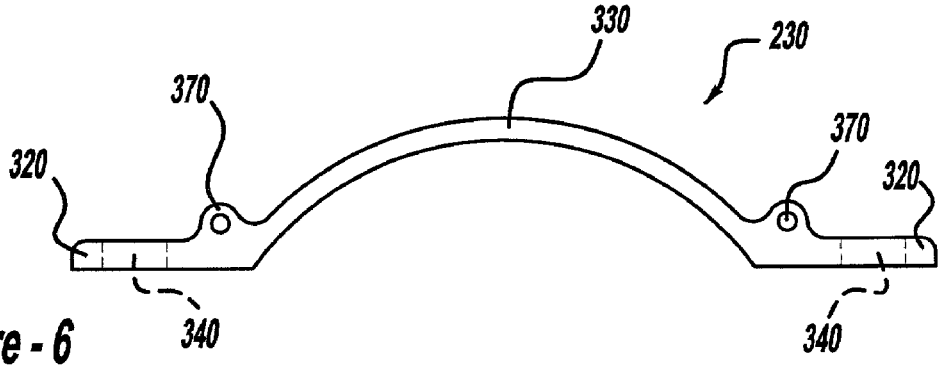
FIG. 6 is a schematic illustration of the handle which is attached to a top surface of the main base.
Figure 3:
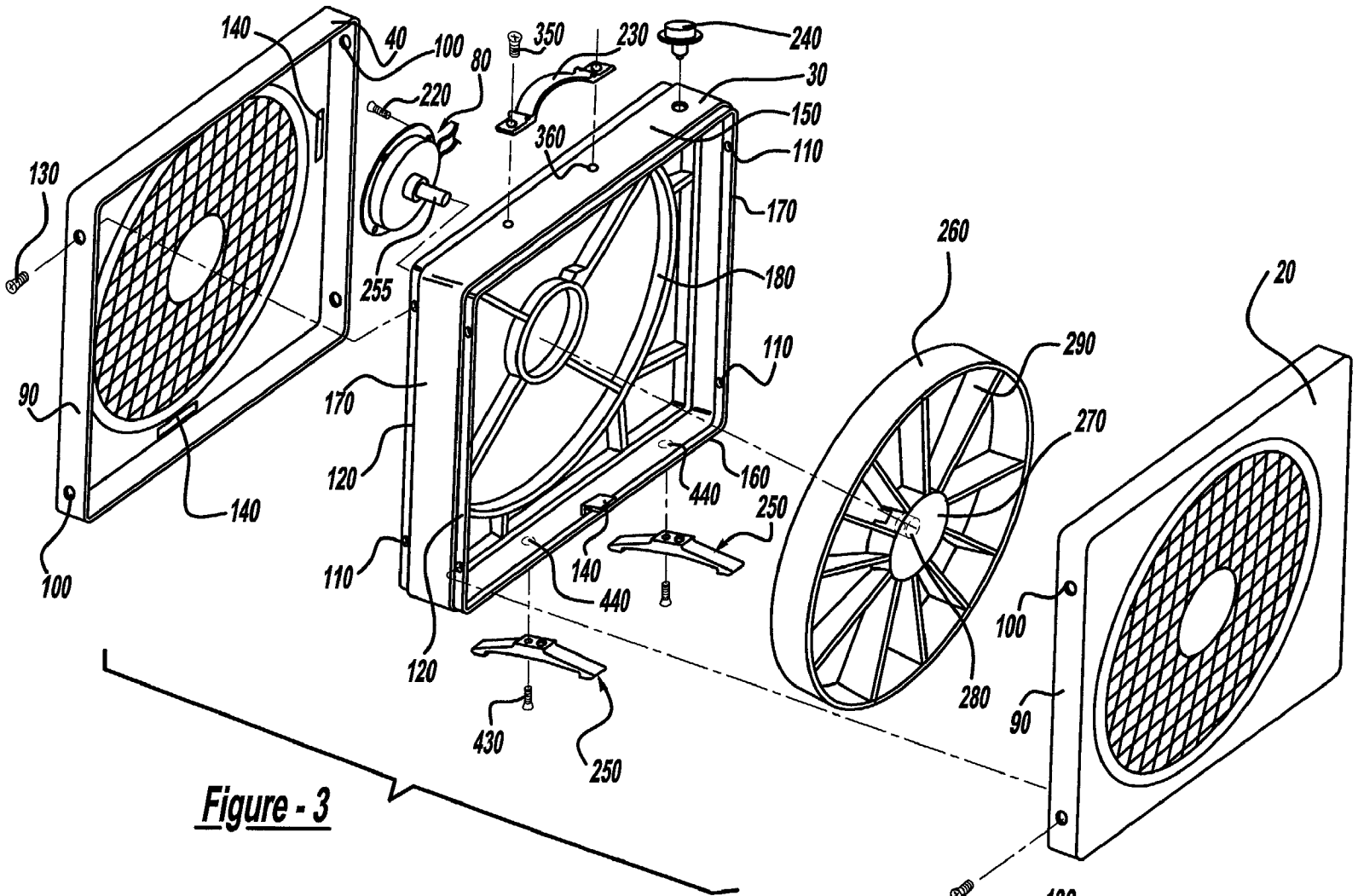
FIG. 3 is an exploded view of the air circulation device of FIG. 1.

The elongated support 250 is fastened to the bottom face 160 of the air circulation device 10 by a suitable fastening means, preferably in the form of a screw 430, at raised mid-portion 400. The fastening device engages both the receptor 410 and a similar receptor 440 located in bottom face 160 so as to securely fasten the elongated support 250 to the device 10. Eventhough the elongated support 250 is securely fastened to bottom face 160, the support 250 is able to rotate radially about the fastening device. Such rotation enables the support 250 to rotate between positions A and B as illustrated in FIG. 5.

When the elongated support 250 is rotated to extended position A, the contact portions 390 are at their furthest distance from the device 10. As a result, the elongated support 250 is able to adequately support the weight of the device 10 in an upright position. This prevents the device 10 from falling either on its front face 20 or rear face 40. To insure that the elongated support 250 remains locked in extended position A, the knob 420 cooperates in a snap fit manner with a dimple 450 on the bottom face 160. The elongated support 250 may be moved from locked position A through the application of radial force to either end of the support 250. The force will dislodge the knob 420 from cooperating with dimple 450 and enable the support 250 to be moved to another position such as position B or any desired position between A or B.

When the elongated support 250 is rotated to contracted position B, the length of the support runs parallel with bottom face 160 and no portion of the support extends beyond bottom face 160. As a result, when the device is subject to the normal jostling and contact that occurs during the movement of articles, the support 250 will be protected from being dislodged or damaged.

The above described device 10 and all of its components, except for the motor casing 80 and the associated 12-volt DC motor, are made of a water resistant polymeric material. Consequently, the device may be subject to liquid solutions without being corroded or damaged in any way. Such a property is desirable because it provides for a device which may be, for example, exposed to rain water or cleaned with a liquid cleaning solution applied using either a hand towel or a high pressure hose without being damaged.

The physical dimensions of the above described device 10 provide for a very thin housing thickness on the range of approximately four and a quarter inches. Further, device 10 has an overall height of approximately fourteen and three quarters of an inch and a width of approximately thirteen and a half inches. Such dimensions are desirable because they allow device 10 to be of a sufficiently small overall size so that the device 10 may be easily transported and only occupy a minimal area. It must be noted that even though device 10 is of a small overall size, the large diameter of fan blade 260 and the 12-volt DC power source allow device 10 to produce an air current that is equal to or greater than that produced by devices having greater overall physical dimensions. The above described overall dimensions of device 10 and the ability of device 10 to produce such a massive air current are made possible by the dimensions of the flat motor within motor casing 80 and the short length of the axle 255. Specifically, motor casing 80 is approximately less than one inch thick with a diameter of approximately four and a quarter inches. Further, the axle 255 is less than one and a half inches in length.

Thus, a 12-volt DC air circulation device is provided. Advantageously, the device produces an air current of a magnitude similar to that provided by air circulation devices powered by 120-volt alternating current. Moreover, the device includes at least one elongated stand member which may be secured in an extended position, so as to vertically support the device upon a surface, or a retracted position, so as to protect the support from damage during transport of the device. Further, the device is made from a polymeric material and has a sealed motor and bearings so as to allow the device to be easily cleaned with a liquid solution without damaging the device.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An air circulation device comprising:

a self standing housing assembly having a front face portion, a main base portion, and a rear face portion, the base portion having a thin low profile 12 volt direct current motor and a fan blade;

an electrical connection device coupled with said motor, said electrical connection device for coupling with a socket in a motor vehicle;

a rigid casing sealing the motor and associated motor bearings, said rigid casing providing protection against damage from external forces, said rigid casing is sealed to be liquid impermeable enabling said air circulation device to be subjected to highly pressurized liquids for cleaning said fan blades while preventing corrosion and damage due to the liquid, said casing is made of a rigid, non-corrosive material such that it is able to withstand external forces and pressures such as those exerted by the application of highly pressurized liquids, said casing covering said motor having a thickness around one inch to provide a low profile motor assembly, and wherein the device, excluding the motor and casing, is made of a polymeric material.

2. The air circulation device of claim 1, wherein the base portion contains at least one elongated support portion.

3. The air circulation device of claim 2, wherein the elongated support portion is capable of being pivotally disposed in an extended position, a contracted position, or any desired intermediary position.

4. The air circulation device of claim 3, wherein the elongated support portion is secured into the extended position through the cooperation of a knob, disposed upon the elongated support portion, and a dimple, formed in the bottom face of the main base.

5. An air circulation device comprising:

a housing assembly having a front face portion, a main base portion, and a rear face portion, the base portion having a motor and a fan blade;

wherein a bottom face of the main base portion includes at least one elongated support member secured to said bottom face by a fastening member; and wherein the elongated support portion is pivotally disposed about said fastening member and manually positioned in an extended position, a contracted position, or any desired intermediary position between the extended and contracted position for supporting the air circulation device in a number of different elongated support member positions; and said elongated support portion is secured into the extended position through the cooperation of a knob, disposed upon the elongated support portion, and a dimple, formed in the bottom face of the main base.

6. The air circulation device of claim 5, wherein the motor is powered by 12-volt direct current.

7. The air circulation device of claim 5, wherein the motor as well as motor bearings associated with said motor are sealed within a rigid casing.

8. The air circulation device of claim 7, wherein the casing is sealed so as to be impermeable to liquid.

9. The air circulation device of claim 7, wherein the casing is made of a rigid, non-corrosive material such that it is able to withstand external forces and pressures such as those exerted by the application of highly pressurized liquids.

10. The air circulation device of claim 5, wherein the device, excluding the motor and associated casing, is made of a polymeric material.

11. The air circulation device of claim 5, wherein the housing has a thickness of about three inches.

* * * * *